United States Patent [19]

Kaufman

[11] 4,004,346

[45] Jan. 25, 1977

[54] MACHINE FOR THE MULTIPLE GRADING OF PATTERNS FROM A MASTER PATTERN

[76] Inventor: William Kaufman, 4 Stonehurst Court, Pomona, N.Y. 10970

[22] Filed: July 28, 1975

[21] Appl. No.: 599,832

[52] U.S. Cl. ..... 33/17 A

[51] Int. Cl.[2] ..... A41H 3/00

[58] Field of Search ..... 33/12, 17, 23 H, 23 G, 33/23 F, 24 C; 248/287, 295, 297, 298

[56] References Cited

UNITED STATES PATENTS

| | | | |
|---|---|---|---|
| 377,456 | 2/1888 | Haitz | 248/287 |
| 833,613 | 10/1906 | Maiser | 248/298 |
| 870,333 | 11/1907 | Woodward | 33/23 F |
| 2,013,681 | 9/1935 | Budelman | 33/23 F |
| 2,091,262 | 8/1937 | Aster | 33/17 R |
| 2,972,188 | 2/1961 | Kaufman | 33/17 A |

FOREIGN PATENTS OR APPLICATIONS

| | | | |
|---|---|---|---|
| 154,672 | 10/1963 | U.S.S.R. | 33/17 A |

*Primary Examiner*—Richard E. Aegerter
*Assistant Examiner*—John W. Shepperd
*Attorney, Agent, or Firm*—Edward F. Levy

[57] ABSTRACT

A multiple pattern grading machine includes an open, horizontally-disposed support frame within which a table is movably mounted by means of parallelogram linkages connecting the opposite ends of the table to the adjacent ends of the support frame. The parallelogram linkages also mount a plurality of channel bars arranged in corresponding pairs at opposite ends of the table, each corresponding pair of channel bars being adapted to mount a sheet of pattern reproducing paper therebetween, with the paper sheets arranged in a superimposed stack across the table. A selected pair of channel bars mounts a rigid grid for mounting master pattern sections located above the uppermost sheet in such a manner that each of the pattern reproducing sheets and the master pattern sections are moved relative to one another in varying increments of distance when the table is manually moved in the frame. The rigid grid supporting the master pattern sections is formed of a pair of bars extending longitudinally along opposite sides of the frame and a plurality of extensible, spring tensioned straps connecting said bars.

9 Claims, 9 Drawing Figures

MACHINE FOR THE MULTIPLE GRADING OF PATTERNS FROM A MASTER PATTERN

The present invention relates to improvements in apparatus for making a plurality of graded patterns from a master pattern, and in particular relates to novel and improved master pattern holding means for apparatus of this type.

In my prior U.S. Pat. No. 2,972,188, there is disclosed a pattern grading machine of large industrial size which is capable of mounting a plurality of master pattern sections at the same time and grading these sections simultaneously to produce a number of pattern reproductions from each master pattern section, upon large sheets of paper, the pattern reproductions conforming in shape and configuration to their corresponding master pattern section, but being graded upwardly and/or downwardly in sizes so that from one master pattern section of a selected size, a set of pattern reproductions may be marked and cut in an entire range of standard clothing sizes.

The machine of said U.S. Pat. No. 2,972,188 includes a large rectangular open frame having legs supporting the frame on a ground surface, and a table set within the frame for longitudinal and transverse movement therein. At each end, the table is connected to the frame by a pair of parallelogram linkages which provide such table movement, and each end of the table and the end walls of the frame mount channel bars in which pattern reproducing sheets are mounted. Additional channel bars are mounted at intermediate points on the parallelogram linkages, these channel bars being also adapted to mount pattern reproducing sheets therein. Each pattern reproducing sheet extends from one channel bar at one end of the frame to the corresponding channel bar at the other end of the frame, and the sheets are thus stacked in superimposed relationship over the surface of the table. One of the pairs of channel bars is also used for mounting one or more master pattern sections. Such mounting is accomplished by means of an elongated bar extending between said pair of channel bars and connected thereto at one side of the table, and one or more pattern support bars mounted on said elongated bar and extending over the table in cantilever fashion, the free ends of the support bars carrying clamping means for holding the master pattern sections. Because of the large size of the machine, the relatively heavy weight of the master pattern sections, and the cantilever construction of the support arms for the master pattern sections, the support arms tend to bend or sway in a transverse direction during the pattern grading operation, causing misplacement or misalignment of the master pattern sheets supported thereby. This in turn causes inaccuracies in the graded patterns produced by the machine so that some or all of the graded patterns must occasionally be discarded because they are reproduced in inaccurate shapes or sizes. In addition, the use of single support arms to mount the master pattern sections severely limits the number of such sections which can be mounted at the same time for simultaneous grading.

It is an object of the present invention to provide a pattern grading machine of the character described which is provided with improved mounting means for the master pattern sections, which mounting means eliminates the aforesaid disadvantages of the conventional cantilever type mounting means.

Another object of the invention is the provision of a pattern grading machine of the character described which includes a rigid gridwork for mounting the master pattern sections, this gridwork being movable as a unit with the pair of channel bars in which it is mounted, and eliminating any tendency of the master pattern sections to sway or become misaligned during the grading operation.

Still another object of the invention is the provision of a pattern grading machine of the character described in which the aforementioned gridwork is formed of a pair of longitudinally-extending bars connecting a selected pair of channel bars at opposite sides of the support frame, and a plurality of master pattern-supporting straps connected in spaced parallel relationship between said bars, and extending across the table, each of the straps being stretched under spring tension between said bars.

A further object of the invention is the provision of a pattern grading machine of the character described in which the rigid gridwork formed by the supporting straps covers an area substantially coextensive with the surface of the table so that an appreciable number of master pattern sections may be mounted at one time on the gridwork for simultaneous grading.

In accordance with the invention there is provided a multiple pattern grading machine which comprises a support frame, a horizontally-disposed table movably mounted within said support frame and connected thereto at each end by a plurality of parallelogram linkages, a plurality of channel bars mounted on said parallelogram linkages for movement relative to the support frame in varying increments of distance when said table is moved, means for mounting a plurality of pattern reproducing sheets in selected corresponding pairs of said channel bars, with said sheets extending in superimposed relationship over the surface of said table, and mounting means for supporting at least one master pattern section above the uppermost pattern reproducing sheet. Said mounting means includes a pair of support bars extending longitudinally along opposite sides of the support frame and connected to a selected pair of channel bars for movement therewith, and a plurality of spaced straps, each mounted at its opposite ends to the respective support bars and extending transversely therebetween, said straps forming a rigid and immovable gridwork overlying the table for mounting of master pattern sections thereon.

The straps are made of telescoping sections so as to be variable in length, with a spring connecting the sections so that when the straps are stretched between the support bars, they are maintained rigid under spring tension.

In one embodiment of the invention, the longitudinally extending support bars carry a plurality of depending pins to which the ends of the respective straps are hooked. In another embodiment, the support bars are each formed as part of a rectangular frame, said frames being pivotally mounted at opposite sides of the support frame on bars connecting the selected pair of channel bars. The pivoted frames may be turned from extended positions overlying the table, to retracted positions remote from the table.

Additional objects and advantages of the invention will become apparent during the course of the following specification when taken in connection with the accompanying drawings, in which.

Figure 1:
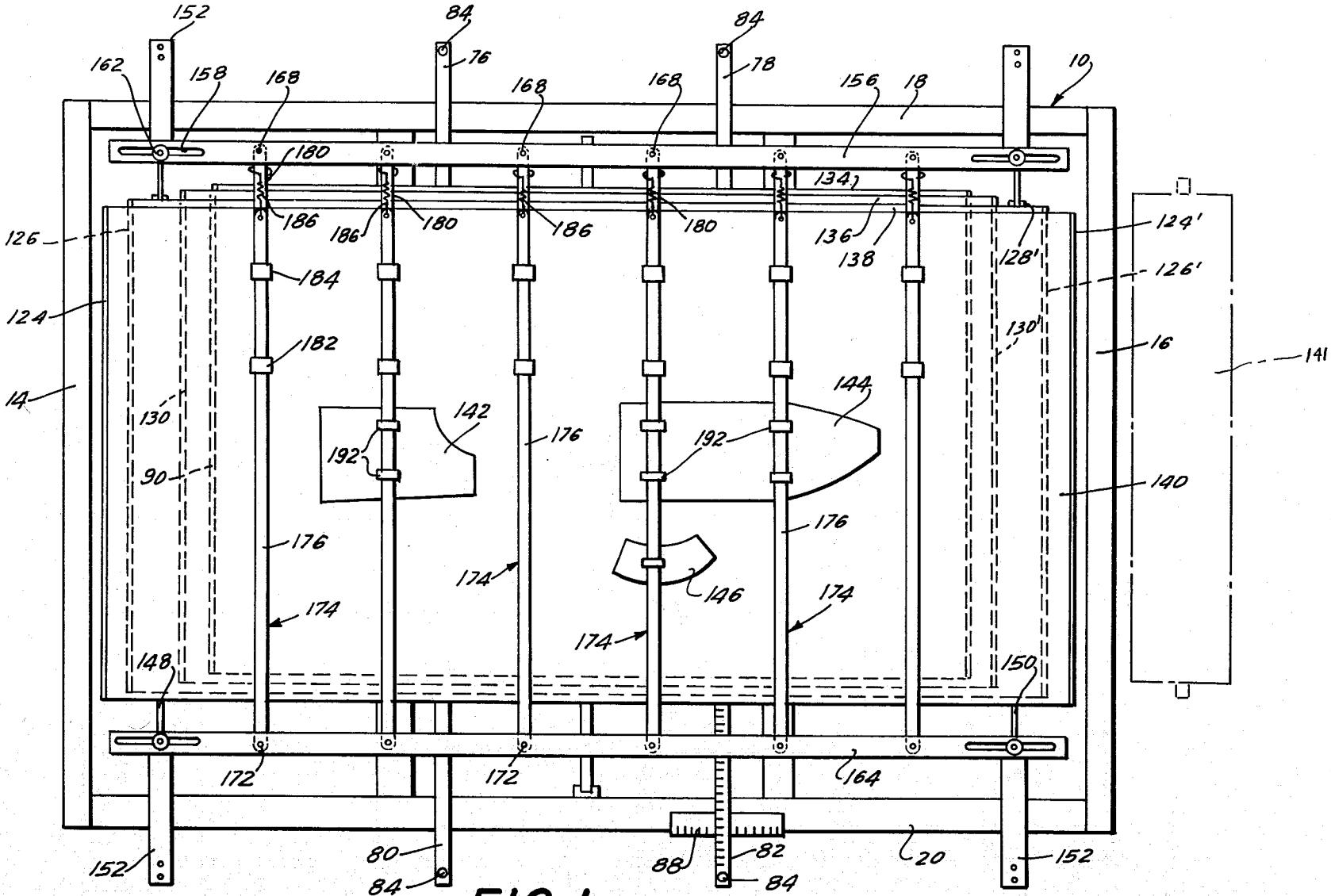
FIG. 1 is a top plan view of a pattern grading machine incorporating one preferred embodiment of the master pattern holding means of the present invention.

Referring in detail to the drawings, there is shown in FIGS. 1–4 a pattern grading machine of the type shown and described in my aforementioned U.S. Pat. No. 2,972,188. The construction and operation of the machine is described in detail in said patent, and only so much of such description will be included herein as is required for an understanding of the present invention.

The machine includes a large rectangular support frame 10 which rests upon a floor surface and a table 12 mounted within the confines of the frame 10. The table 12 is horizontally disposed, and is horizontally movable in all directions relative to the support frame 10 which is stationary. The support frame 10 has end walls 14 and 16, side walls 18 and 20, and legs 24 which support the frame on the floor surface. Extending between the side walls 18 and 20, and secured thereto are a pair of metal channel bars 26 and 28 which serve as supporting rails for a frame 30 carrying the table 12.

Figure 2:
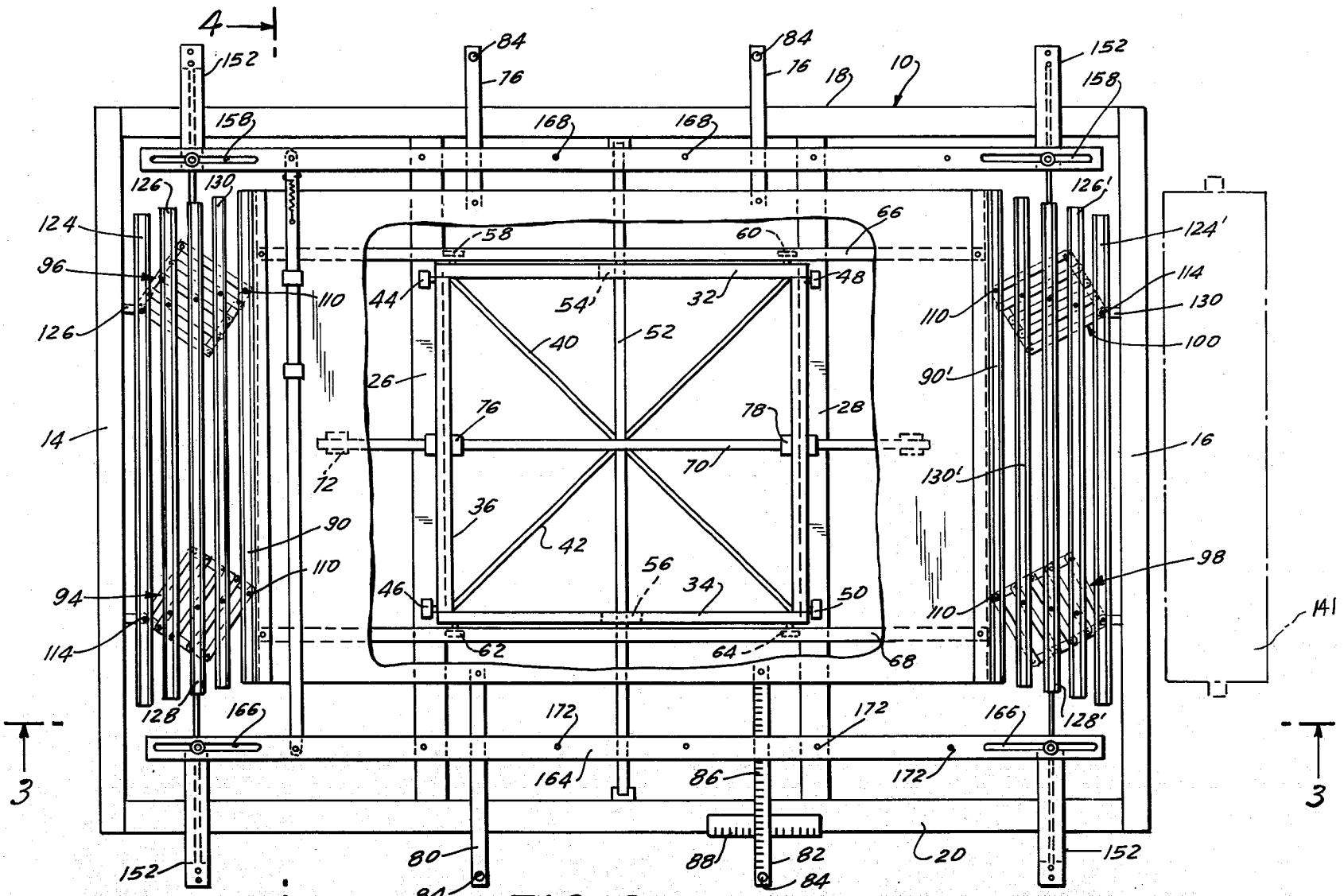
FIG. 2 is a top plan view of the pattern grading machine of FIG. 1, with the pattern reproducing sheets removed and a portion of the table broken away to reveal inner constructional details.

As shown in FIG. 2, the frame 30 is square in shape and is formed of side bars 32, 34 and end bars 36, 38, these bars comprising angle irons. Diagonal struts 40 and 42 may be employed to rigidify the frame structure.

Along one end bar 36, the frame 30 is provided with a pair of rollers or wheels 44 and 46 which rest upon channel bar 26 and roll thereupon. A similar pair of rollers or wheels 48 and 50 are mounted upon the frame end bar 38, and rest upon channel bar 28 to roll thereupon. The frame 30 is thus able to roll upon rails 26 and 28 in a direction transverse to the longitudinal axis of the support frame 12, that is between the side walls 18 and 20. To guide the frame 30 in such transverse movement, a cylindrical guide rod 52 is secured at its ends to the frame side walls 18 and 20, and extends perpendicularly therebetween, being centered between the rails 26 and 28. The guide rod 52 extends slidably through plates 54 and 56 depending from the central portions of the respective frame side bars 32 and 34. The plates 54 and 56 may be provided with anit-friction devices such as roller bearings (not shown) to facilitate the sliding movement of the guide rod 52 therethrough.

The table 12 is mounted on the frame 30 for longitudinal sliding movement relative thereto. For this purpose, the frame side bar 32 mounts a pair of wheels or rollers 58 and 60, while the frame side bar 34 similarly mounts a pair of wheels or rollers 62 and 64. The rollers 58, 60, 62 and 64 are located at a higher level than the rollers 44, 46, 48 and 50. A pair of spaced metal bars 66 and 68 are mounted on the under surface of the table 12, the bar 66 resting upon the rollers 62 and 64. A cylindrical guide bar 70 is mounted at its ends in bars 72 and 74 depending from the lower surface of table 12. The guide bar 70 extends parallel to the lower table surface and is spaced therefrom, also extending slidably through sleeves 76 and 78 respectively mounted centrally upon frame end bars 36 and 38.

The table 12 is provided with handle means comprising a pair of bars 76, 78 secured to one side of the table and projecting laterally therefrom, and a similar pair of bars 80, 82 projecting laterally from the other side of the table. Each of the bars 76, 78 and 80, 82 mounts an upstanding handle 84 which may be grasped by the operator for moving the table 12 in a horizontal plane relative to the support frame 10. When the table is moved in a longitudinal direction, that is, toward either of the end walls 14 or 16, the table rides upon the frame 30 by means of rollers 58, 60, 62 and 64, the frame 30 remaining stationary. On the other hand, when the table 12, is moved in a transverse direction, that is, toward either of the side walls 18 or 20, the frame 30 moved in unison with the table, its rollers 44, 46, 48 and 50 riding upon channel bars 26 and 28. Any other horizontal movement of the table 12 relative to the support frame 10 has a longitudinal component and a transverse component so that table 12 has a free, universal horizontal movement relative to the support frame.

As shown in FIG. 2, the bar 82 is provided with a row of calibrations 86 and cooperates with a perpendicular row of calibrations 88 on the top surface of support frame side wall 20. These rows of calibrations serve to indicate to the user the precise distance by which the table 12 is shifted horizontally in respective transverse and longitudinal directions.

Along the opposite end edges of table 12, a pair of channel bars 90 and 90¹ are securely mounted. The channel bar 90 is connected to the end wall 14 of support frame 10 by a pair of spaced parallel open linkages 94 and 96. Similarly, the channel bar 90¹ is connected to the opposite end wall 16 of support frame 10 by a pair of parallelogram linkages 98 and 100. The parallelogram linkages 94, 96, 98 and 100 are all of indentical construction and each includes four outer links 102, 104, 106 and 108 interconnected at their adjacent ends by respective pivot pins 110, 112, 114 and 116. Each parallel linkage 94, 96, 98 and 100 also includes three intermediate links 118, 120 and 122 pivotally connected at their ends to the respective links 102 and 106, and extending parallel to the links 104 and 108.

At the left-hand side of the table 12, the pivot pin 110 of each of the parallelogram linkages 94 and 96 is connected to an integral flange of the channel bar 90, and is thus pivotally affixed to the table 12. The pivot pin 114 of each parallelogram linkage 94 and 96 is connected to a channel bar 124 affixed to the end wall 14 by lugs 126.

Similarly, on the right-hand side of the table 12, the pivot pin 110 of each of the parallelogram linkages 98 and 100 is connected to an integral flange of channel bar 90[1], while the pivot pin 114 is connected to a channel bar 124[1] affixed to the end wall 16 by lugs 130.

Three additional channel bars 126, 128 and 130 are located between the channel bars 90 and 124 and are mounted on and carried by the parallelogram linkages 94 and 96. The channel bar 126 is connected to the intermediate link 118 of each parallelogram linkage 94 and 96 by a pivot pin 132, while the channel bar 128 is connected to intermediate link 120 by pivot pin 134, and channel bar 130 is connected to intermediate link 122 by pivot pin 136. Similarly, on the other side of the table, the channel bar 126[1] is connected to the intermediate link 118 of each parallelogram linkage 98 and 100 by pivot pin 138, the channel bar 128[1] is connected to the intermediate link 120 by pivot pin 140 and the channel bar 130[1] is connected to intermediate link 122 by pivot pin 142.

Figure 3:
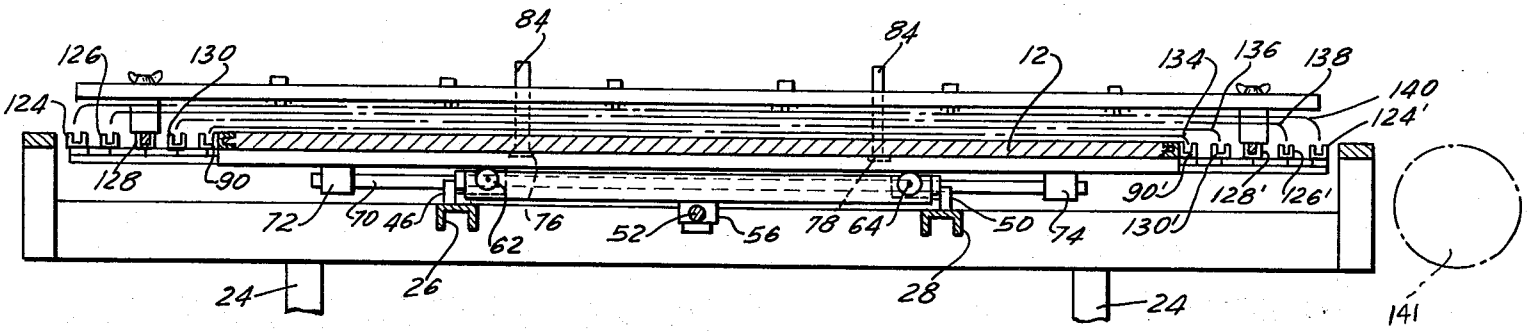
FIG. 3 is a longitudinal section taken along line 3—3 of FIG. 2.
Figure 4:
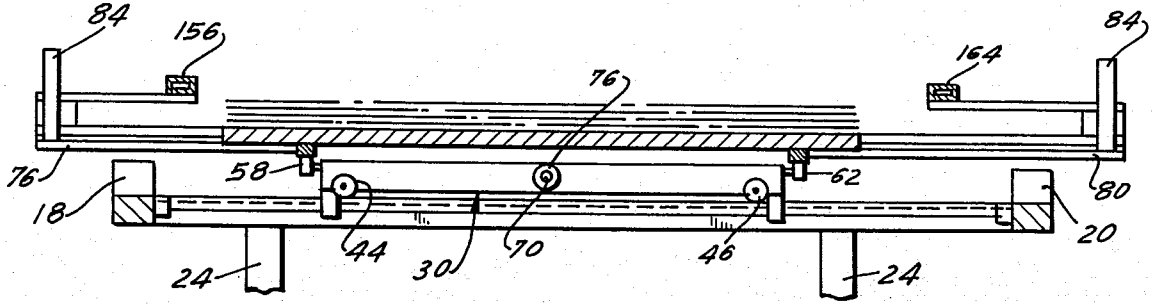
FIG. 4 is a transverse section taken along line 4—4 of FIG. 2.

As shown in FIG. 3, the channel bars 90, 124, 126, 128 and 130, constituting one set at one side of the table, are disposed parallel to each other with their open faces at the top. The channel bars 90[1], 124[1], 126[1] and 130[1] constituting a second set at the other side of the table are identically disposed and arranged. The channel bars are each sized to receive a respective elongated cylindrical rod (not shown) made of heavy metal for retaining the end of a patttern tracing sheet within the channel bar.

In this pattern grading machine, a sheet of pattern tracing paper is mounted between corresponding channel bars at each side of the machine so that the sheets are superimposed and each is stretched across the top of the table 12. To mount a sheet of pattern tracing paper, the sheet is cut to a length slightly longer than the pair of corresponding channel bars upon which it is to be mounted. The sheet is then stretched across the top of the table with its end portions overlying the respective channel bars, and an elongated rod is dropped into the open top of each channel bar to anchor the end portion of the sheet therein. In this manner, a first sheet of tracing paper 134 is stretched over the top of table 12 and mounted at its ends on the pair of channel bars 90 and 90[1] which are secured to the ends of table 12 and move therewith. A second sheet 136 is stretched over the first sheet 134 and its ends are mounted in the pair of channel bars 130 and 130[1], as shown in FIG. 3. A third sheet 138 is then stretched over the second sheet 136, and its ends are mounted in the channel bars 126 and 126[1]. Finally, a fourth sheet 140 of tracing paper is stretched over the third sheet 138, and its ends are mounted in the channel bars 124 and 124[1] which are secured to the respective frame end walls 14 and 16, and do not move during the grading operation.

It will be observed that no sheet of tracing paper is mounted between the intermediate channel bars 128 and 128[1] since this pair of channel bars has been selected for mounting the master patterns which are to be graded. FIG. 1 shows three master pattern sections 142, 144 and 146 mounted to overlie the uppermost pattern tracing sheet 140 and connected to the aforesaid intermediate channel bars 128 and 128[1] by a structure made in accordance with the present invention and to be described in detail hereinafter. It is to be understood that the master patterns may be selectively mounted in any of the pairs of channel bars 90, 90[1], 130, 130[1], 128, 128[1] or 126, 126[1], depending on the size of the master pattern provided and the requirements of the particular grading operation to be performed. It is preferred that the master patterns be not mounted in the immovable end channel bars 124, 124[1], since for proper quality grading, the master patterns should be movable relative to the machine frame and relative to all of the tracing sheets which underlie the master patterns.

Figure 2A:
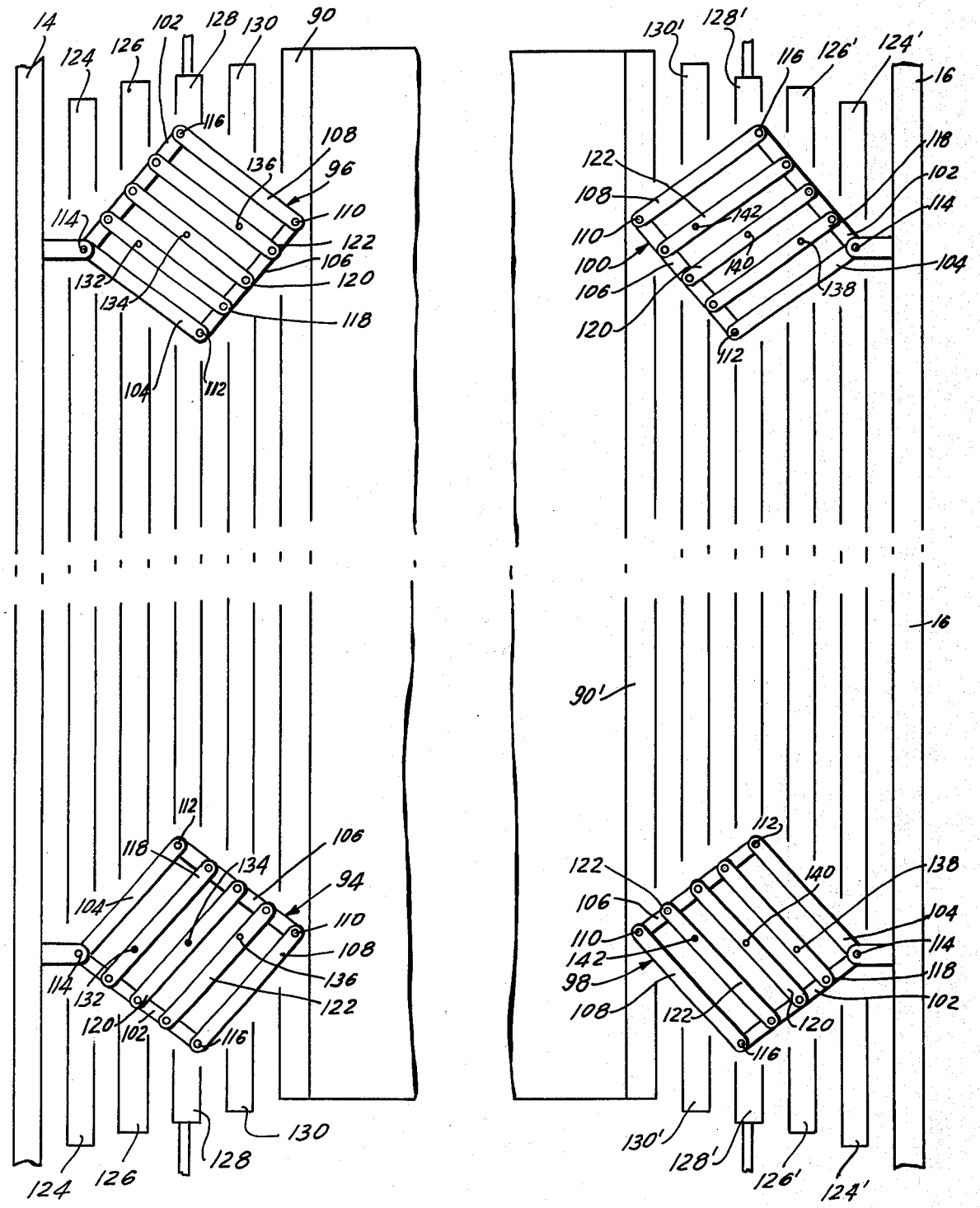
FIG. 2A is an enlarged top plan view of a broken-away portion of the machine, showing details of the parallelogram linkages which mount the channel bars.

In operation, the handles 84 at either side of the frame 10 are grasped, and the table 12 is moved horizontally relative to the fixed frame 10 in either a longitudinal or transverse direction or in an angular direction having both longitudinal and transverse components. Movement of the table 12 causes movement of all of the channel bars and the pattern tracing sheets mounted therein, except for the end pair of stationary channel bars 124 and 124[1]. The nature of the parallelogram linkages is such that when the table 12 is moved in any direction, the channel bars are all moved in the same direction but with each pair of channel bars moving through a different distance. If, for example, the table 12 is moved to the left, from its position shown in FIGS. 2 and 2A, by a distance of four inches, the channel bar 90, carried by the table 12, will move away from the bar 124, affixed the frame 14, by a distance of four inches, while the channel bar 90[1], at the right-hand side of table 12, will move toward the channel bar 124[1] by the same distance of four inches. This results in the lowermost tracing sheet 134 being shifted to the left relative to the stationary top tracing sheet 140, by a distance of four inches at the same time, the central pair of movable channel bars 128 and 128[1], and the master pattern carried thereby, are moved to the left by half the aforementioned distance, that is by a distance of two inches. The pair of channel bars 126 and 126[1] and the tracing sheet carried thereby are moved to the left through a distance of one-quarter of the distance of movement of the table, or a distance of one inch, while the pair of channel bars 130, 130[1], and the tracing sheet 136 carried thereby, is moved to the left by a distance of three inches. Thus, relative to the master patterns which have been moved during this grading movement, the two pattern tracing sheets 138 and 140 have shifted to the right of the master patterns for down-grading, while the two sheets 134 and 136 have shifted to the left of the master patterns for up-grading. It will therefore be appreciated that while movement of all the movable channel bars, movable tracing sheets and the master patterns are in the same direction, the tracing sheets have shifted relative to the master patterns in opposite directions and in selected proportional increments for a range of graded patterns.

The table 12 is successively shifted in various directions in accordance with standard grading procedures, and after each shift, selected points or surfaces of the master patterns are transferred to the underlying tracing sheets 134, 136, 138 and 140 by marking, if the tracing sheets are of the type made of the well-known "carbonless" copy paper, or by punching through the sheets at selected points with a suitable punching tool, or cutting through the sheets with a cutting machine or tool. In any event, after the grading operation in concluded, each tracing sheet will have an outlined reproduction of the master pattern or patterns, with each reproduction being of a different size. If the master pattern selected is of a size corresponding to the standard clothing size sixteen, for example, in the example illustrated, the tracing sheets will produce patterns of the same configuration in smaller sizes twelve and fourteen, as well as in larger sizes eighteen and twenty.

The operation of the machine in the grading procedure is more fully described in my aforementioned U.S. Pat. No. 2,972,188, and reference is made thereto for further disclosure. In this prior patent, the master pattern or patterns were coupled to the appropriate pair of channels bars by a single cross bar which bridged and connected said pair of channel bars and which in turn mounted a pair of pattern supporting bars. These pattern supporting bars extend above the surface of the table 12 and at their ends, the master pattern or patterns are mounted. These master patterns are made of heavy paper or cardboard, and are relatively heavy, and because of the cantilever nature of the pattern supporting bars, the master patterns are inclined to sway during their movement as the table is shifted, and during the process of marking the pattern tracing sheets. This slight swaying movement of the pattern supporting bars, and of the master patterns carried thereby, often results in mis-alignment of the master patterns and consequent inaccuracies in the size and shape of the patterns reproduced. A feature of the present invention is an improved mount for the master patterns which eliminates any tendency for the master patterns to sway or shift, which mounting construction will not be described.

Figure 5:
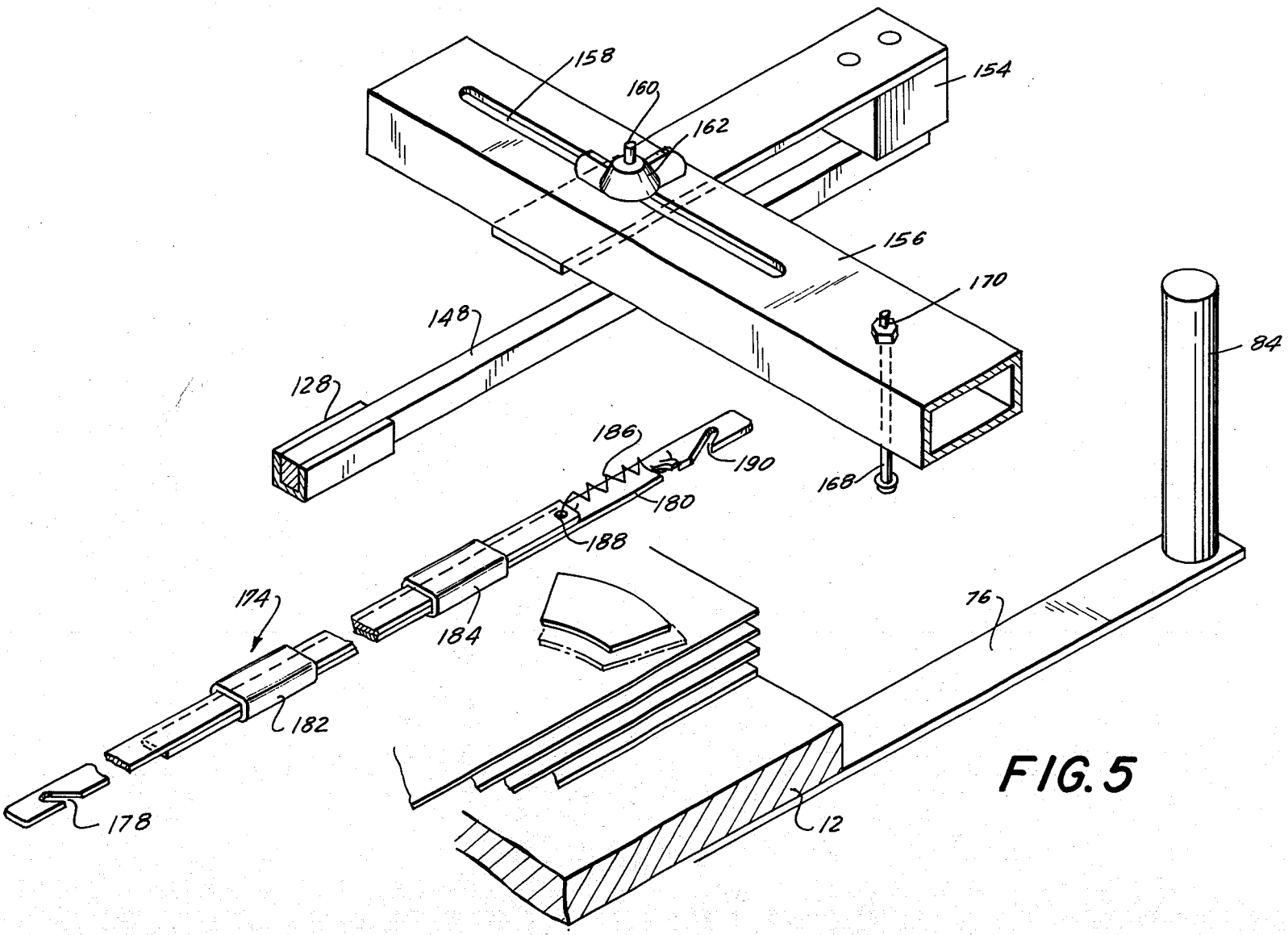
FIG. 5 is an enlarged exploded isometric view of portions of the machine of FIGS. 1 and 2.

One embodiment of the master pattern mounting assembly of the invention is shown in FIGS. 1 and 2, and in detail in FIG. 5. The mounting assembly includes a pair of metal rods 148 and 150 which extend through the respective channel bars 128 and 128*a*. The rods 148 and 150 are of square cross-section, as shown in FIG. 5, and are sized to fit snugly within the channel bars 128 and 128*a*. The rods 148 and 150 project from each end of the respective channel bars 128 and 128*a*, as shown in FIGS. 1 and 2 and each projecting end is secured to a flat plate 152 by a spacer block 154, the latter mounting the plate 152 spaced above the end of the rods 148 and 150 and parallel thereto. At one side of the frame 10, the plates 152 mounted on the projecting ends of rods 148 and 150 are secured to a strap support member in the nature of an elongated hollow bar 156 of rectangular cross-section, as shown in FIG. 5. Each end portion of the bar 156 is formed with an elongated longitudinal slot 158. A screw shank 160 secured to, and upstanding from the respective plate 152 extends through each of the slots 158 and mounts a wing nut 162. These wing nuts 162 are tightened to clamp the ends of the hollow bar 156 tightly against the respective plate 152.

As shown in FIGS. 1 and 2, the hollow bar 156 extends between the rods 148 and 150 proximate to the frame side wall 18 and parallel thereto. At the opposite side of the frame 10, a similar strap support member in the nature of a hollow bar 164 is mounted proximate to and parallel to the frame side wall 20. The hollow bar 164 is also provided at its ends with elongated longitudinal slots 166 through which extend screw shanks 160 secured to plates 152 mounted on the respective rods 148 and 150.

The elongated slots 158 and 166 are provided to enable the hollow bars 156 and 164 to be mounted on the rods 148 and 150 regardless of the channel bars in which the rods 148 and 150 are placed. Thus, if the rods are set within the pair of channel bars 130 and 130[1] rather than the channel bars 128 and 128[1] as shown, so that the rods 148 and 150 are more closely spaced, the upstanding screw shanks 160 will still extend through the elongated slots 158 and 166. The length of the slots also enables the rods 148 and 150 to be mounted in the pair of channel bars 126 and 126[1].

The hollow bar 156 mounts a series of spaced retaining pins 168 which extend through the interior of bar 156 and depend therefrom. The retaining pins 168 are held in mounted position by nuts 170. The hollow bar 164 is similarly provided with a row of spaced retaining pins 172 which are aligned with the retaining pins 168. The retaining pins 168 and 172 are adapted to mount a plurality of metal straps 174 which extend transversely between the hollow bars 156 and 164, and mount the master patterns.

Each of the straps 174 comprises a narrow elongated flat strip 176 of flexible metal such as stainless steel which is formed with an angular slot 178 forming a hook at one end thereof, as shown in FIG. 5. At its other end, the strap 174 is provided with a second flat flexible strip 180, similar to the strip 176 but of shorter length. The strip 180 underlies the strip 176 and is held in flat, sliding contact therewith by a pair of tubular metal bands 182 and 184. A coiled tension spring 186 has one end anchored in a hole 188 at the end of strip 176 and is secured at its other end to the end portion of the second strip 180 which projects beyond the adjacent end of the strip 176. This projecting end portion of the second strip 180 is provided with an angular slot 190 forming a hook.

Each of the straps 174 is made of an over-all length somewhat shorter than the distance between the pins 168 of bar 156 and pins 172 of bar 164. To mount a strap 174 between a pair of aligned pins 168 and 172, therefore, the strap must be elongated by sliding the second strip 180 outwardly relative to the strip 176, and thereby tensioning spring 186. In mounting a strap 174, the slot 178 at the end of strip 176 is fitted over a selected retaining pin 172 on bar 164, and the strap is then stretched by extending the second strip 180 outwardly against the tension of spring 186 so that the slot 190 at the end of strip 180 may be fitted upon the aligned retaining pin 168 of bar 156. The strap 174 thus extends between the aligned pins 168 and 172, perpendicularly to the hollow bars 156 and 164 and to the longitudinal axis of the frame 10. FIG. 1 shows six evenly-spaced straps 174 mounted between all of the pairs of the retaining pins 168 and 172 provided on the hollow bars 156 and 164. It is to be understood, however, that a lesser number of straps 174 may be mounted, if desired, depending upon the size and number of master pattern sections to be graded in a single operation. In any event, it will be seen that each mounted strap 174 is stretched between an aligned pair of retaining pins under tension of spring 186, so that the mounted straps provide a rigid grid-like structure for mounting the master pattern sections.

In FIG. 1, by way of example, three master pattern sections 142, 144 and 146, representing different portions of the same garment, are shown mounted on selected supporting straps 174. The pattern sections may be secured to the straps 174 in any suitable manner, it having been found that short strips of pressure-sensitive adhesive tape 192 are best suited for such mounting. Since the straps 176 provide a mounting area extending substantially over the entire extent of the table 12, a large number of pattern sections may be mounted at one time for simultaneous grading, resulting in a appreciable saving of time in the grading operation, and therefore a greatly improved efficiency of the grading machine. The stretched straps 176, because of their pin mounts at each end, cannot bend or sway transversely and they hold the mounted master pattern sections closely adjacent to or in contact with the upper surface of the top marking sheet 140, so that there is no possibility of the master pattern sheets swaying or becoming misaligned during the grading operation.

Figure 6:
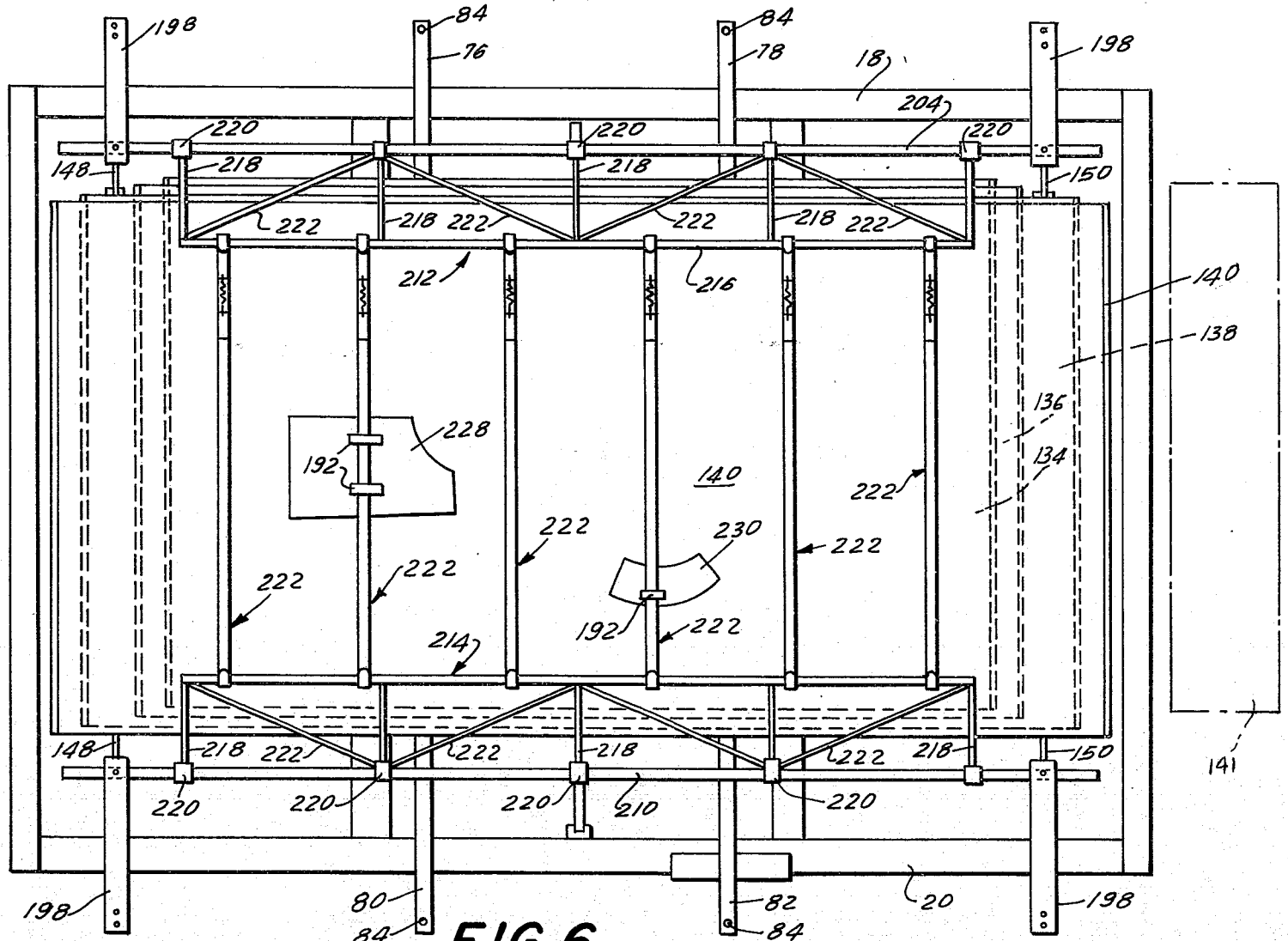
FIG. 6 is a top plan view of a pattern grading machine incorporating a second preferred embodiment of master pattern holding means made in accordance with the invention, the pivotal frames of said holding means being shown in their extended positions with master pattern supporting straps connected therebetween.
Figure 7:
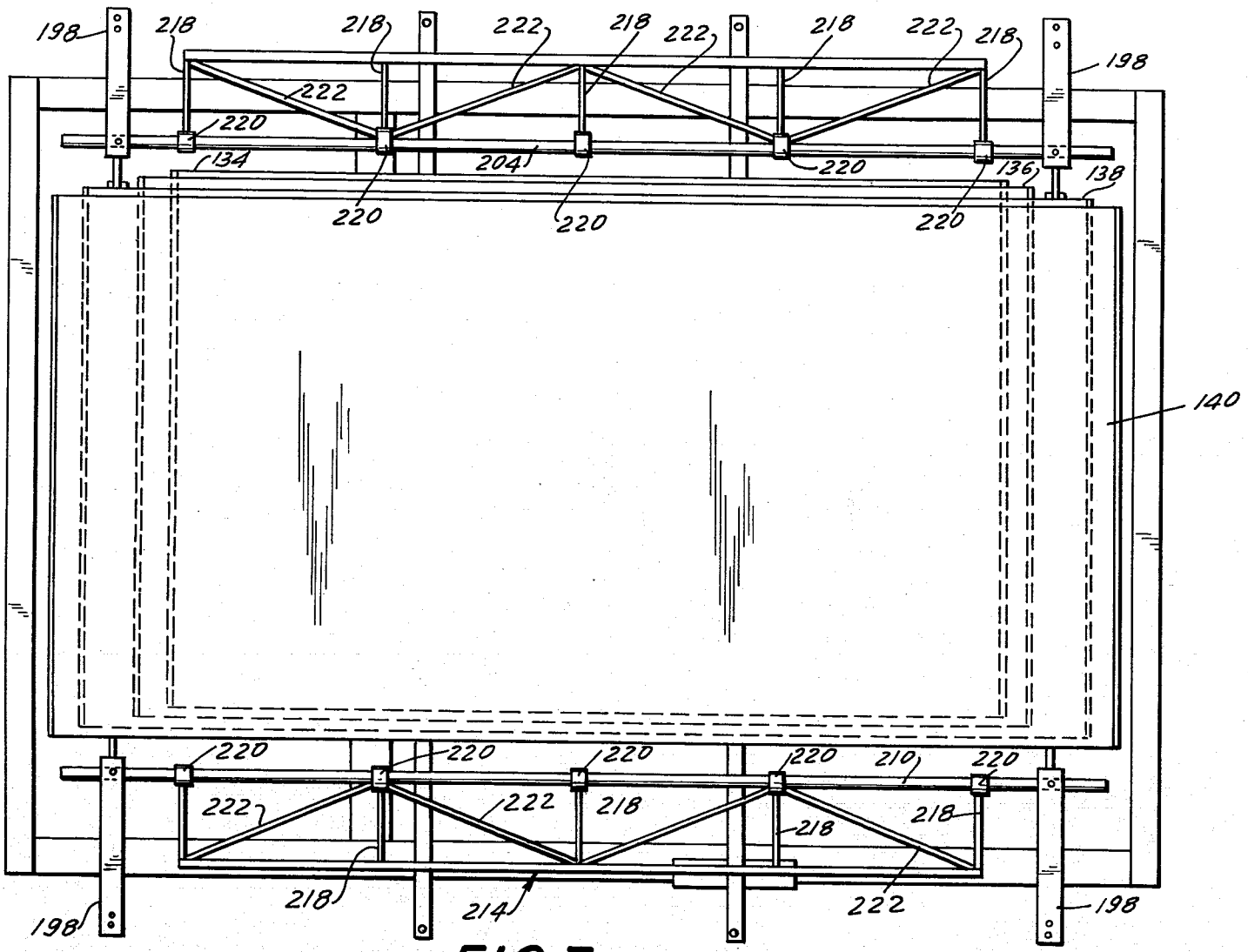
FIG. 7 is a top plan view of the pattern grading machine shown in FIG. 6, but with the supporting straps removed and the pivotal frames shown in their retracted positions.
Figure 8:
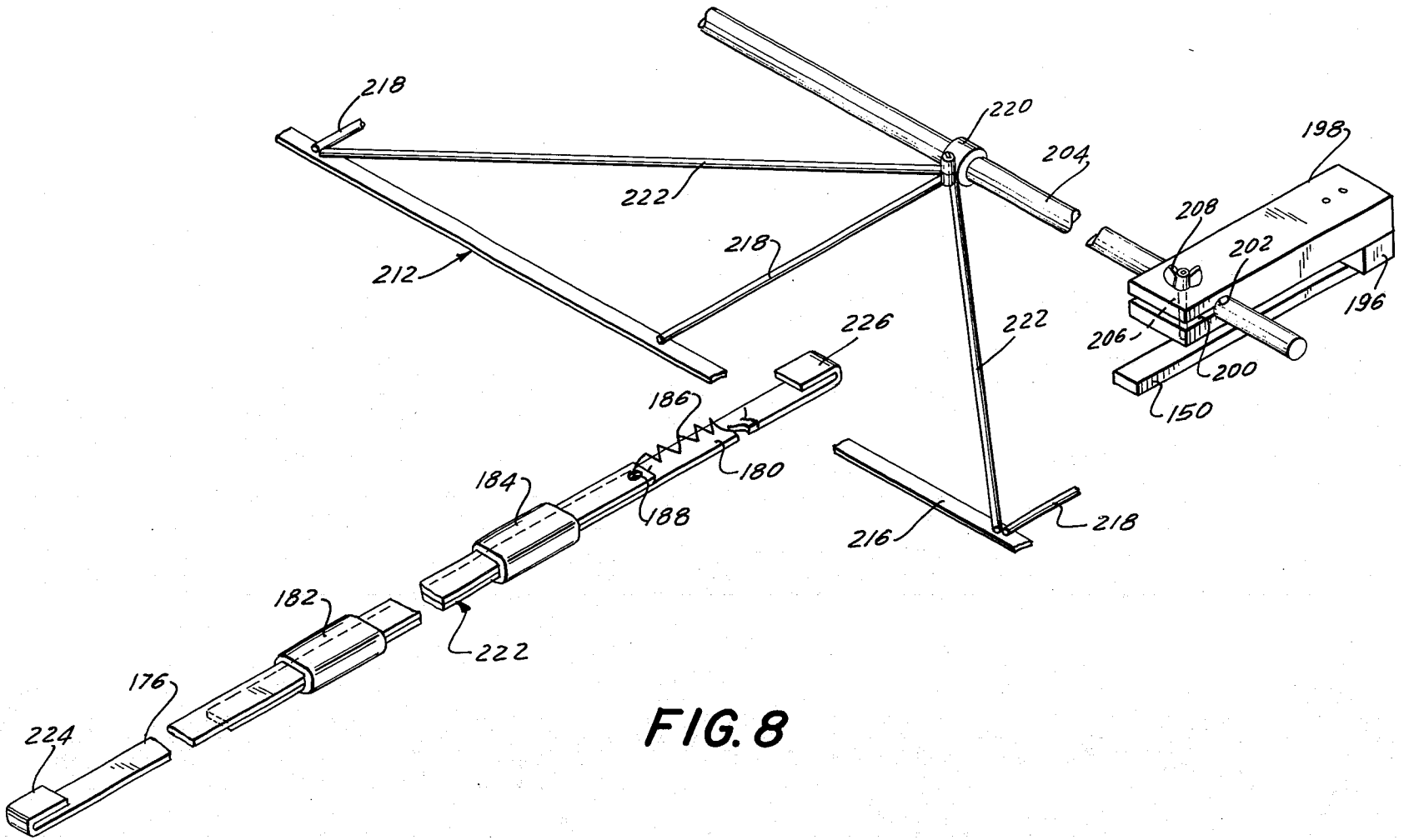
FIG. 8 is an enlarged exploded isometric view of a portion of one of the pivotal frames, its mounting structure, and a support strap to be connected thereto.

FIGS. 6, 7 and 8 illustrate a modified embodiment of master pattern mounting means made in accordance with the present invention. In this embodiment, the rods 148 and 150 again terminate at each end in a spacer block 196 mounting a flat plate 198 which is relatively thick. The free inner end of the plate is cut to provide a narrow slot 200 which communicates with a circular bore 202 extending transversely through the plate 198. At the side of the frame 10 adjacent its side wall 18, the two plates 198 support therebetween a bar 204 of circular cross-section, the ends of bar 204 extending through the bores 202 of the respective plates 198, and each end being clamped in its corresponding bore 202 by a bolt 206 and wing nut 208, as shown in FIG. 8. At the other side of frame 10 adjacent the side wall 20, an identical bar 210 of circular cross section is similarly mounted between the two plates 198 at this side of the frame. Pivotally mounted on the bar 204 is a rectangular strap supporting frame 212, while an identical strap supporting frame 214 is pivotally mounted on the bar 210 at the other side of the frame 10.

Each of the strap supporting frames 212 and 214 comprises an elongated, longitudinally extending flat bar 216, to which are secured a plurality of spaced, transversely extending bars 218, each terminating in a circular hinge ring 220. A plurality of angularly-disposed struts 222 also connect each hinge ring 218 to the longitudinal bar 216 to complete the structure of the rectangular frame and reinforce the same into a rigid structure. The hinge rings 220 of the frame 212 are rotatably mounted on the cylindrical bar 204 in the manner shown in FIGS. 6 and 8, while the hinge rings 220 of the frame 214 are similarly mounted on the cylindrical bar 210 at the other side of the support frame 10. By means of this hinged mounting of the frames 212 and 214 on the respective bars 204 and 210, both frames may be turned between the extended, operative position, shown in FIG. 6, in which the frame overlies the adjacent side portion of the table 12 and is parallel thereto, and the retracted position shown in FIG. 7, in which the frames 212 and 214 extend outwardly and overlie the respective support frame side walls 18 and 20, and are clear of the table 12. The frames 212 and 214 may be turned to their retracted positions of FIG. 7 to enable the pattern tracing sheets to be mounted in the respective channel bars and removed and replaced therein, and may then be turned to their extended positions of FIG. 6 to enable the master pattern supporting straps to be connected therebetween.

The master pattern supporting straps 222 employed in this embodiment are identical in construction to the straps 174 of the previous embodiment, except that they are shorter in length, and the flat strip 176 and second strip 180 each terminate in a reversely bent end portion 224 and 226 forming a flat hook. The straps 222 are again extendible by the telescopic movement of the strips 176 and 180, under tension of spring 186.

When the frames 212 and 214 are in their extended positons of FIG. 6, the straps 222 may be easily mounted thereon by hooking the bent end portion 226 upon the flat longitudinally extending bar 216 of frame 212 at a selected point thereon, stretching the strap against tension of the spring 186, and hooking the opposite bent end portion 224 upon the bar 216 of the opposite frame 214 at an aligned point. FIG. 6 shows six straps 222 so mounted between frames 212 and 214, and supporting master pattern sections 228 and 230 by means of tape strips 192. It will be appreciated that in this embodiment, the straps 222 may be mounted at any desired points along the flat frame bars 216 and are not restricted in their mounting points by the provision of pre-set mounting pins as in the previous embodiment. The hinged frames 212 and 214 provide with the supporting straps 222 a rigid framework or grill extending over the entire extent of the table 12, on which master pattern sections may be mounted in secure and immovable positions without any tendency to sway or become misaligned during the grading operation. The straps 222 may be quickly and easily removed and the frames 212 and 214 turned to their retracted positions in which they do not obstruct the operating surface of the table, in order to permit the pattern sheets to be removed and replaced.

While preferred embodiments of the invention have been shown and described herein, it is obvious that numerous omissions, changes and additions may be made in such embodiments without departing from the spirit and scope of the invention.

What is claimed is:

1. A pattern grading machine comprising a support frame, a horizontally disposed table, slide means movably mounting said table on said support frame, a plurality of parallelogram linkages, a plurality of paper holding bars mounted on said parallelogram linkages for movement with said linkages relative to said support frame in varying increments of distance when table is moved, each of said paper holding bars comprising a channel bar having an open upper end, means for mounting a plurality of pattern reproducing sheets in selected corresponding pairs of said paper holding bars, with said sheets stacked in superimposed relationship over the surface of said table, and mounting means for supporting at least one master pattern section above the uppermost pattern reproducing sheet, said master pattern mounting means comprising a pair of elongated strap supports extending longitudinally of said support frame and spaced from each other on opposite sides of the central axis of said table, coupling means removably securing said strap supports to a selected pair of said paper holding bars for movement therewith, said coupling means comprising a pair of rods mounted in a selected pair of channel bars and projecting from the opposite ends thereof, a mounting member secured to each projecting end of each rod, and clamp means secured to each mounting member and engaging the respective strap support, at least one strap, means releasably mounting said strap at its opposite ends to the respective strap supports and extending transversely therebetween, said straps forming with said strap supports a rigid framework overlying said table for supporting master pattern sections thereon.

2. A pattern grading machine according to claim 1 which includes a plurality of spaced straps, each mounted at their opposite ends to the respective strap supports.

3. A pattern grading machine according to claim 1 in which each of said straps comprises a pair of flat metal strips, means mounting said strips in aligned abutting relationship for longitudinal sliding movement relative to each other between an elongated position and a retracted position, and spring means urging said strips to said retracted position.

4. A pattern grading machine according to claim 3 in which each strip of each of said straps has attaching means on the free outer end thereof, said attaching means being adapted to engage and grip the respective strap supports for mounting said strap stretched in its elongated position between said strap supports.

5. A pattern grading machine according to claim 4 in which each of said straps is flexible in a direction perpendicular to the plane of said table surface and rigid in a direction parallel to said table surface.

6. A pattern grading machine according to claim 4 in which each of said strap supports mounts a longitudinal row of spaced pins projecting from the surface thereof, said attaching means of each of said straps being removably attachable to aligned pins on said strap supports for mounting each strap between said strap supports.

7. A pattern grading machine according to claim 4 in which each of said strap supports forms a portion of an open rectangular frame including an elongated rod mounted upon and extending between said selected pair of paper holding bars, and hinge members pivotally mounting said frame on said elongated rod, each of said frames being pivotally movable between an extended operative position overlying a portion of said table and a retracted position remote from said table.

8. A pattern grading machine according to claim 7 in which each of said frames includes a plurality of spaced transverse rods connecting the respective strap support to said rod in spaced parallel relationship thereto, and in which each strap support has a thin flat body sized to receive the attaching means of said straps.

9. A pattern grading machine according to claim 1 in which each strap support has an elongated longitudinal slot adjacent each end thereof, and in which said clamp means includes a screw shank upstanding from each of said mounting members and extending through one of said elongated slots.

* * * * *